United States Patent [19]

Scherer

[11] 4,163,894

[45] Aug. 7, 1979

[54] OVEN HAVING A DILUTING VENTILATION SYSTEM

[75] Inventor: Richard M. Scherer, Oxford, Miss.

[73] Assignee: Chambers Corporation, Oxford, Miss.

[21] Appl. No.: 858,641

[22] Filed: Dec. 8, 1977

[51] Int. Cl.[2] ..... F24C 15/32; F24C 15/20

[52] U.S. Cl. ..... 219/391; 126/21 R; 126/299 F; 219/393; 219/402; 219/408

[58] Field of Search ..... 219/391, 396, 400, 402, 219/373, 392-395, 397-399, 401, 403-405, 390, 408; 126/19 R, 21 R, 21 A, 299 F, 41 R

[56] References Cited

U.S. PATENT DOCUMENTS

| | | | |
|---|---|---|---|
| 2,158,881 | 5/1939 | McCormick | 126/21 R |
| 2,339,365 | 1/1944 | Guilder | 126/21 R |
| 2,582,887 | 1/1952 | Sanford et al | 126/1 |
| 3,327,094 | 6/1967 | Martin et al. | 126/21 A |
| 3,384,067 | 5/1968 | Rawald et al | 126/21 R |
| 3,462,583 | 8/1969 | Holtkamp | 219/402 |
| 3,470,353 | 9/1969 | Holtkamp | 219/400 |
| 3,499,430 | 3/1970 | Kemp | 126/21 R |
| 3,548,152 | 12/1970 | Klepzig | 219/400 |
| 3,858,568 | 1/1975 | Seldel | 126/299 R |
| 3,962,561 | 6/1976 | Maitenaz | 219/391 |
| 3,982,096 | 9/1976 | Dills | 219/403 |

FOREIGN PATENT DOCUMENTS

| | | | |
|---|---|---|---|
| 1238465 | 7/1971 | United Kingdom | 219/392 |

*Primary Examiner*—Thomas J. Kozma
*Assistant Examiner*—Bernard Roskoski
*Attorney, Agent, or Firm*—Richards, Harris & Medlock

[57] ABSTRACT

The specification discloses a self-cleaning oven including an outer housing with an oven liner disposed within the housing in a spaced-apart relationship forming cavities between the housing and liner walls. A duct system is provided for directing air from the vicinity of the lower front and rear of the oven to the cavity between the top walls of the housing and liner. A heating element is mounted in a proximate relationship to a smoke eliminator panel mounted on the top liner wall. Smoke and gases emanating from the oven pass through apertures formed in the smoke eliminator panel to a vent tube. The vent tube discharges gases from the smoke eliminator panel into a discharge duct above the oven liner. A diluter tube encompassing the vent tube allows air to pass from the cavity between the top walls of the oven liner and the housing into the discharge duct. The air dilutes the smoke and gases from the oven liner, and the diluted smoke and gases are then exhausted from apertures in the front of the oven. In this arrangement, air flow results from thermal currents, and a fan is not required.

15 Claims, 7 Drawing Figures

OVEN HAVING A DILUTING VENTILATION SYSTEM

FIELD OF INVENTION

The present invention relates to an oven, and more particularly to an oven with a ventilation system for exhausting and diluting oven liner gases and including an improved broiler heating element and smoke eliminator panel.

BACKGROUND OF INVENTION

Ovens heretofore developed have been known to have ventilation systems for exhausting gases from the oven liner and for diluting those gases with air before discharging them into the area surrounding the oven. Such ovens have generally employed forced air ventilation systems and thermal current ventilation systems. A forced air system uses a mechanical fan for circulating air through the oven, whereas a thermal current ventilation system utilizes air flow caused by oven heat to direct air through the desired passages.

Forced air ventilation systems have been found generally effective, but the cost of the fan represents an additional expense. Furthermore, if for any reason the fan becomes inoperable, the oven may heat its surroundings to a dangerously high temperature. For these reasons, a passive ventilation system using naturally forming thermal currents is often preferrable to the forced air system.

Prior passive ventilation systems normally produce a smaller volume of air flow than the forced air systems. The reduced air flow in some ovens has resulted in inadequate cooling characteristics and unsatisfactory dilution of oven liner gases before discharge. A need has thus arisen for a passive ventilation system having improved cooling characteristics which provides a mechanism for adequately diluting and cooling oven liner gases.

Smoke eliminating panels have also been previously used in conjunction with broiler heating elements in order to reduce the amount of smoke vented from an oven. However, such smoke eliminating panels and their associated heating elements have not only not provided desirable uniform radiant heat distribution inside an oven, but have not been integrated in the design of an oven venting system in order to provide improved cooling and ventilation.

SUMMARY OF INVENTION

In accordance with an aspect of the present invention, air is drawn from the vicinity of the lower front and rear of the oven and is directed through intake ducts along the rear wall of the oven to a cavity between the top walls of the oven liner and housing. Inside the oven liner an electrical heating element is located near apertures in a smoke eliminator panel which is mounted below the interior top surface of the oven liner. Gases pass from the oven liner through the aforementioned apertures in the smoke eliminator panel. When these gases pass the heating element, the gases are oxidized and decomposed. The liner gases are then directed through a vent tube into a discharge duct. As the gases are transmitted through the vent tube, they ar further oxidized and decomposed by a three layer catalytic screen disposed therein. Air from the cavity between the top walls of the oven liner and housing is also introduced into the discharge duct by means of a diluter tube which encompasses the vent tube. The air inside the diluter tube is heated by the vent tube and rises into the discharge duct. Thereby drawing more air into the diluter tube through apertures encircling the lower portion thereof. The air and gases flowing into the discharge duct force the gases horizontally through the duct and out vents located on the front face of the oven.

In accordance with another aspect of the present invention, the aforementioned top discharge duct is hemi-toroidal in shape forming a semicircle with a rectangular cross-section. The duct receives gases at an inlet located near the vertex of the hemi-toroid and discharges the gases at the two distal ends of the duct adjacent the front face of the oven.

In accordance with another aspect of the present invention, an improved heating element and smoke eliminator panel are provided. The heating element of the present invention is a continuous electrical conductor with a plurality of U-bends forming six parallel heating element segments disposed adjacent the top of the oven liner running from front to rear. The six parallel segments are distributed symmetrically and uniformly across the top of the oven from side-to-side. The middle two parallel segments are shorter than the other segments and are recessed towards the rear of the oven. The middle segments extend towards the front of the oven for a distance of about two-thirds the depth of the oven liner. The smoke eliminator panel on which the heating element is mounted includes a trapezoidal notch removed from the front edge of the panel to conform to the shape of the heating element. The front ends of the two middle segments of the heating element correspond to the interior edge of the trapezoidal notch. In this manner, uniform radiant heat distribution is achieved and user convenience is enhanced by eliminating heating element portions most likely to be touched by the user.

DESCRIPTION OF THE DRAWINGS

For a more complete understanding of the invention and for further aspects and advantages thereof, reference is now made to the accompanying drawings, in which.

DESCRIPTION OF THE PREFERRED EMBODIMENT

Figure 1:
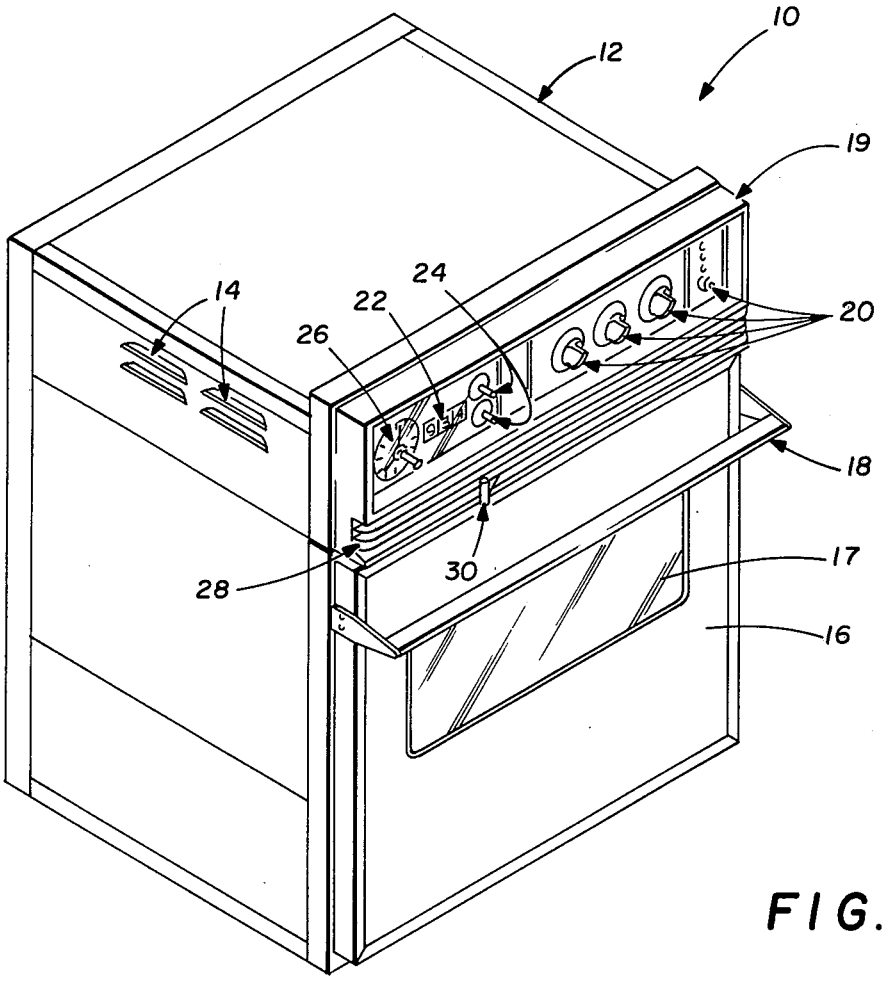
FIG. 1 is a pictorial view of the assembled oven.

Referring now to the drawings and particularly to FIG. 1, there is shown a self-cleaning oven 10 incorporating the invention. Oven 10 includes an oven housing 12, side front vents 14 on either side of the oven for ventilation, an oven door 16 with a window 17 and a door handle 18. A control panel 19 includes oven control knobs 20, a digital clock 22 and associated controls 24, and a conventional timer 26. On the front of the oven, louvers 28 cover vents for exhausting cooled gases and air from the oven. A lever 30 is shown for locking the oven door. The oven structure as shown in FIG. 1 is fabricated of sheet metal and other appropriate materials in a conventional manner.

Figure 2:
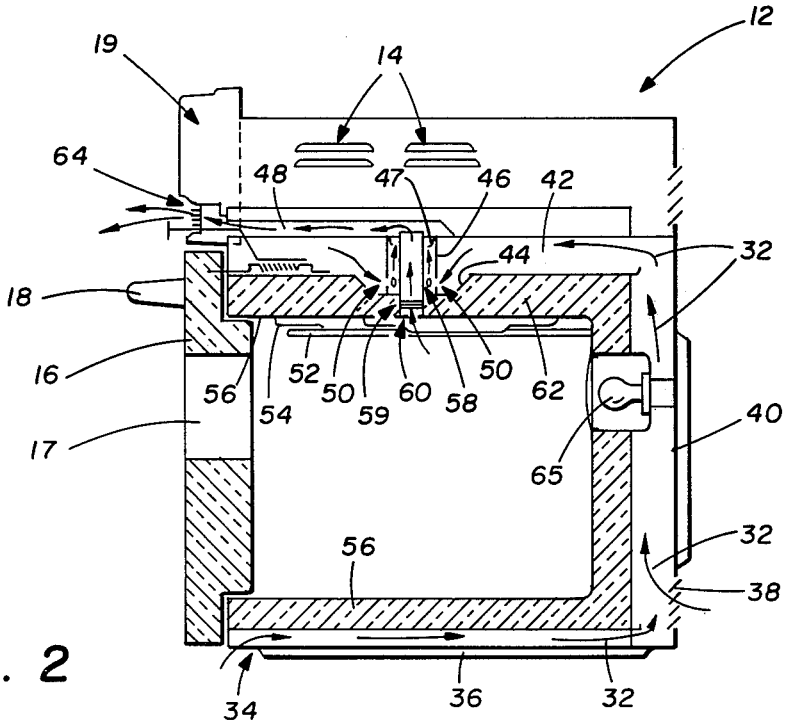
FIG. 2 is a side view of the oven in partial cross-section showing airflow patterns in the ventilation and dilution system.

Referring now to FIG. 2, a side sectional view of the oven 10 is shown, illustrating how heat generated by the oven causes natural thermal currents which draw cool air from the lower front and rear of the oven, mixes the air with hot gases drawn from the oven liner interior and exhausts the mixture out the front of the oven. The oven door 16 is shown in its closed position. Airflow is indicated in FIG. 2 by arrows 32. Air enters an opening 34 in the lower front portion of oven 10 and travels along the bottom of the oven towards the rear of the oven through duct 36. At the rear of the oven, additional air enters the duct system through vent 38 formed in the rear of oven 10. The air is then directed upwardly along the rear wall of the oven through duct 40 towards the top of the oven where it enters a horizontal chamber 42. Chamber 42 includes a truncated conical depression 44, with a vertical diluter tube 46 positioned in the center of depression 44 and extending upward to engage and communicate with a discharge duct 48. Diluter tube 46 includes a series of apertures 50 encircling the lower portion of the diluter tube 46. Apertures 50 allow air to pass from chamber 42 into discharge duct 48 through diluter tube 46. In this manner, relatively cool air as compared to oven liner temperature enters discharge duct 48.

A heating element 52 is mounted beneath a smoke eliminator panel 54 which is in turn mounted below the top interior surface of the oven liner 56. Liner 56 comprises a conventional oven liner made from an integral rectangular metal shell coated with heat resistant porcelain or the like. A light bulb 65 is disposed in the rear of liner 56 in the conventional manner. Panel 54 includes apertures on its lower surface for receiving gases into the panel. A vent tube 58 is positioned to receive gases from the eliminator panel 54 through an aperture 60 in the top of oven liner 56. A three-layer catalytic screen 59 with crimped edges is located in vent tube 58 to further oxidize and otherwise decompose gases and smoke vented from the oven liner 56. Vent tube 58 extends vertically through insulation 62 surrounding the oven liner and passes through the center of diluter tube 46. Vent tube 58 enters discharge duct 48 through inlet 47 and discharges oven gases and smoke into duct 48, where it is diluted and cooled by the air which is introduced by diluter tube 46. The diluted gases then pass through discharge duct 48 and are exhausted out the front of the oven through louvers 64.

The position of the vent tube 58 inside the diluter tube 46 functions to increase airflow in diluter tube 46. The hot gases passing through vent tube 58 heat the tube which in turn heats the surrounding air, causing it to rise inside diluter tube 46. This forces air into chamber 42 and draws air into diluter tube 46 through apertures 50. Tube 46 also acts as a heat shield around vent tube 58.

Figure 3:
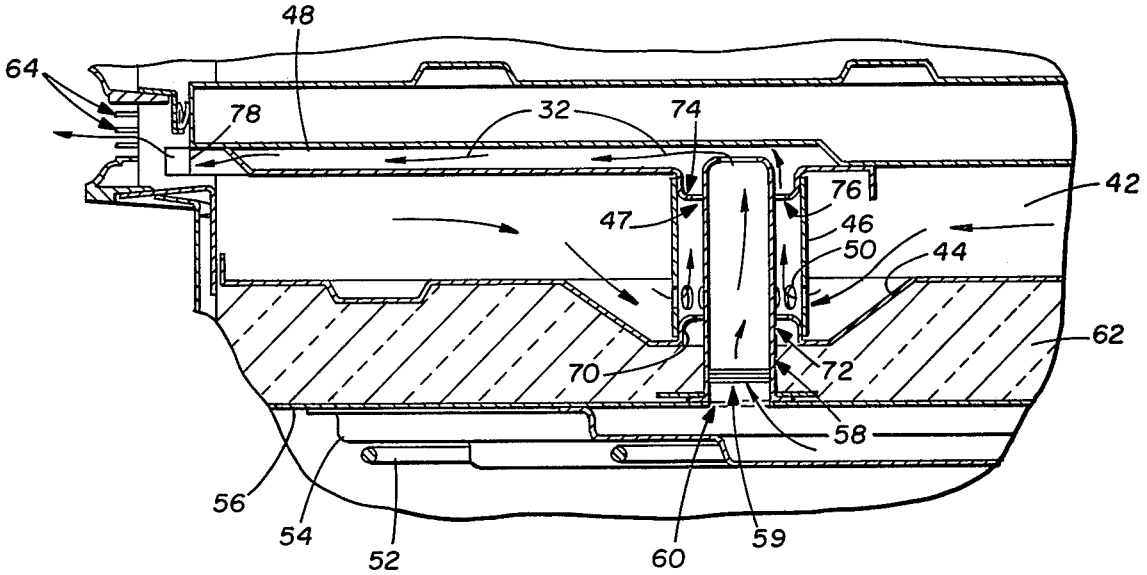
FIG. 3 is a partially cross-sectioned detail of the vent tube, the diluter tube and the associated duct system.

Referring now to FIG. 3, the diluter tube 46, the vent tube 58 and the associated duct system are shown in more detail. The truncated conical depression 44 includes an annular flange 70 extending in an upward vertical direction from the center of depression 44. In the center of annular flange 70, an aperture 72 is formed to allow the vent tube 58 to pass into chamber 42. Diluter tube 46 fits snugly about annular flange 70 and extends in an upward vertical direction. Annular flange 70 serves as a base and as a lateral brace for diluter tube 46.

Discharge duct 48 includes an annular flange 74 located directly above flange 70 and extending from duct 48 in a downward vertical direction. Annular flange 74 includes an inlet 47 for allowing vent tube 58 to enter duct 48. The upper end of diluter tube 46 fits snugly about flange 74. An annular gap 76 is formed between bent tube 58 and flange 74. Through gap 76, the interior of diluter tube 46 communicates with the interior of discharge duct 48. The gases from the oven liner 56 and the cooler air from chamber 42 are mixed in duct 48 and exhausted at the front of the oven through vents 78 and louvers 64. Flange 74 serves as another lateral brace for diluter tube 46.

Figure 4:
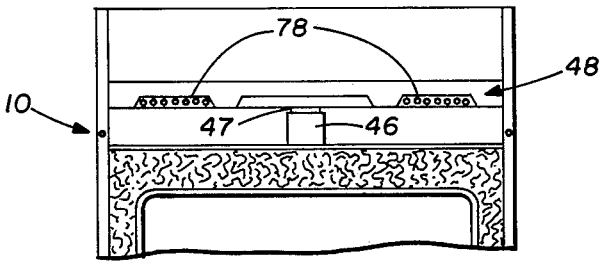
FIG. 4 is a front cross-section detail of the upper portion of the oven showing the diluter tube and the two discharge vents of the discharge duct.
Figure 5:
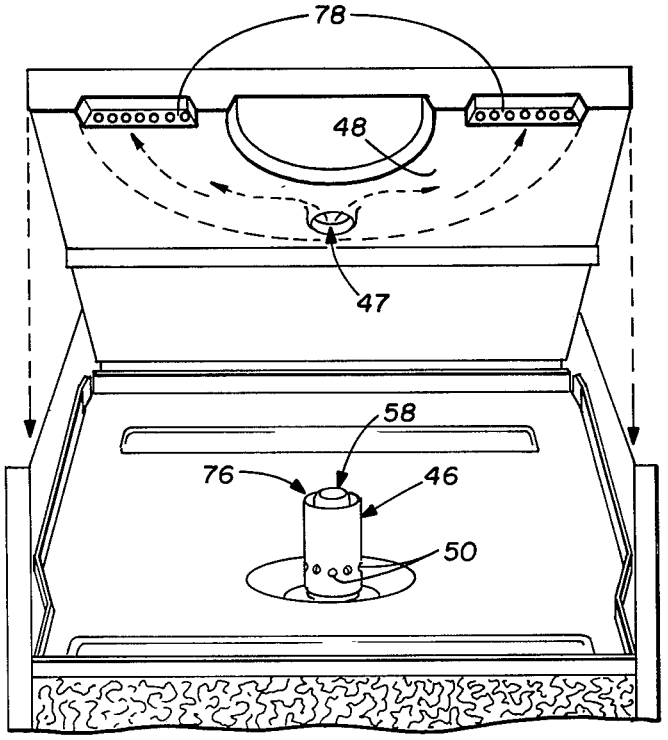
FIG. 5 is a view of the oven top with the top housing panel which supports the discharge duct rotated about an axis formed by the rear edge of the housing panel.

Referring now to FIGS. 4 and 5, the front of oven 10 with the front panel removed is shown. As best shown in FIG. 5, top discharge duct 48 is of a hemi-toroidal shape and resembles a semicircle or a half doughnut. The two ends of the semi-toroidal duct are positioned on the front surface of the oven and are shown in FIG. 4 as vents 78. In FIG. 5, discharge duct 48 is shown rotated in an upward direction removed from the oven. Cool ambient air enters diluter tube 46 through apertures 50. The gases and air from vent tube 58 and diluter tube 46 enter duct 48 through inlet apertures 47. The gas and air mixture must then travel in a circular direction for one quarter of a circle substantially towards the front of the oven where the mixture is discharged through vents 78. The hemi-toroidal shape of discharge duct 48 is designed to provide two passageways to the front of the oven for discharging gases and to provide for increased dispersion and dilution of the gases as they travel through duct 48. The circular duct path and the use of a dual passageway to the front of the oven provides for an efficient dispersion and dilution of the oven gases.

Figure 6:
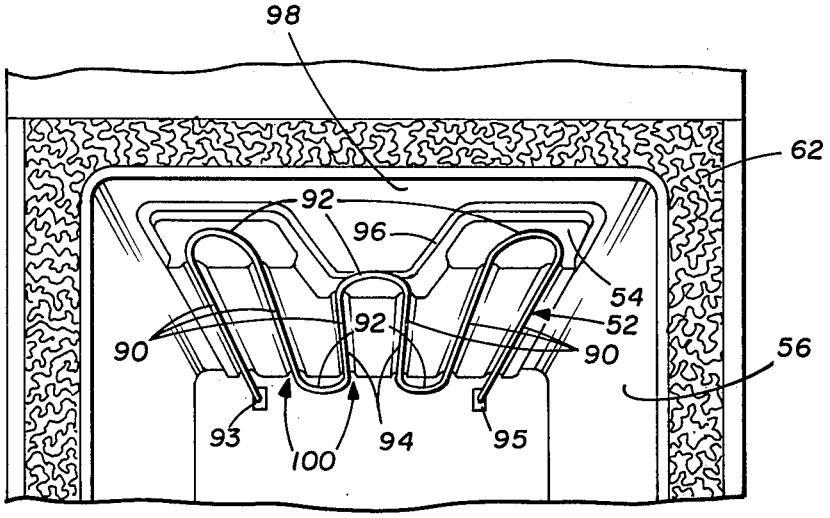
FIG. 6 is a front view detail of the oven liner showing the heating element and the smoke eliminator panel.

Referring now to FIG. 6, heating element 52 is shown mounted on smoke eliminator panel 54. Heating element 52 is composed of six parallel segments 90 connected by U-bends 92 to form a continuous heating element. Receptacles 93 and 95 are provided in the rear wall of liner 56 for connecting heating element 52 to an external electrical power source. The middle two heating element segments 94 are shorter than the other segments and are recessed towards the rear of the oven liner such that they extend from the rear towards the front of the oven for a distance of approximately two-thirds the depth of the oven liner. The smoke eliminator panel 54 includes a trapezoidal notch 96 in its front edge corresponding to segments 94, such that the interior edge of the trapezoidal notch 96 corresponds to the front end of heating element segments 94. In this arrangement, a space 98 is formed in front of the heating element segments 94 within the notch 96 that enhances user convenience and reduces the likelihood that the user will touch the heating element. Furthermore, this arrangement provides for a uniform distribution of radiant heat in the oven liner.

Figure 7:
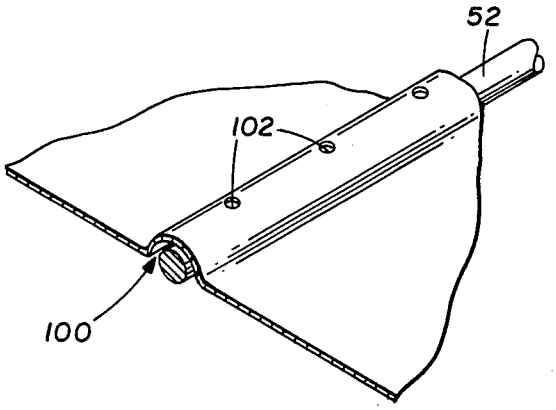
FIG. 7 is a detail of the smoke eliminator panel showing a portion of the heating element as it is mounted adjacent a channel in the smoke eliminator panel.

Heating element 52 is mounted underneath smoke eliminator panel 54 such that the parallel segments 90 are recessed into channels 100 that are formed in panel 54. As shown in FIG. 7, the channels 100 include spaced apart apertures 102 along the apex of the channel. Apertures 102 allow gases to escape from the interior of the oven into the cavity formed above smoke eliminator panel 54. As the oven gases and smoke pass through apertures 102, they must pass by and around heating element 52. In this manner the smoke and gases exhausting through apertures 102 are superheated, thus causing increased oxidation, vaporization and decomposition. These gases are diluted with air before they are exhausted out of the front of the oven as previously described. Due to the superheating and dilution effect, the gases exhausting from the front of the oven are not offensive to the user. The interrelation of the smoke eliminator panel and the gas dilution structure of the invention has been found to provide excellent operating results.

Having thus fully described the preferred embodiment of the present invention, certain modifications of the present invention will be apparent to those persons of ordinary skill in the art. The present invention is intended to cover such modifications as are within the scope and spirit of the appended claims.

What is claimed is:

1. In an oven including a housing and an oven liner, a ventilation system comprising:

a discharge duct defining an enclosed volume within the oven housing and including at least one discharge passageway communicating with the exterior of the oven for discharging air and gases from said discharge duct;

an intake duct disposed below said discharge duct and including at least one intake passageway communicating with the exterior of the oven for receiving air into said intake duct, said intake duct including a first surface disposed above the oven liner and including a second surface disposed below said discharge duct and above said first surface;

a vent tube extending from the oven liner through said first and second surfaces of said intake duct and into said discharge duct for transmitting hot air and gases from the oven liner to said discharge duct, said vent tube being heated by the hot air and gases from the oven liner;

A diluter tube extending between said first and second surfaces of said intake duct and encompassing said vent tube in a spaced apart relationship;

a diluter intake passageway communicating between the interior of said intake duct and the interior of said diluter tube for receiving air into said diluter tube; and a diluter discharge passageway communicating between the interior of said diluter tube and the interior of said discharge duct for discharging air from the diluter tube into the discharge duct, whereby air from the exterior of the oven is transmitted through said intake duct, through said diluter intake passageway, through said diluter tube while being heated by said vent tube, through said diluter discharge passageway and into said discharge duct for being mixed with hot air and gases from said vent tube and discharged from the oven through said discharge passageway.

2. The ventilation system of claim 1 further comprising:

a truncated conical depression formed in said first surface of said intake duct with said diluter and vent tube being positioned at the center of said depression; and an aperture formed in the center of said depression dimensioned to snuggly fit about said vent tube passing therethrough.

3. The ventilation system of claim 1 further comprising:

a lower annular flange extending upwardly from said first surface of said intake duct fitting snuggly within the lower end of said diluter tube to form a lower mounting base therefor; and an upper annular flange extending downwardly from said second surface of said intake duct fitting snuggly within the upper end of said diluter tube to form an upper mounting base therefor.

4. The ventilation system of claim 1 wherein said diluter intake passageway comprises a plurality of apertures disposed circumferentially about said diluter tube and spaced apart equidistantly.

5. In an oven including an oven liner, a smokeless broiler comprising:

a substantially rectangular smoke eliminator panel mounted on the interior top surface of the liner and having a notch portion in the center of the front edge of said eliminator panel forming a recessed cavity in said eliminator panel extending rearward approximately one-third the length of the panel;

a continuous electrical heating element with a plurality of U-shaped bends forming a plurality of coplanar parallel segments extending from the front to the rear of the oven liner, said heating element including two middle segments mounted on said eliminator panel equidistantly from the midregion thereof, being shorter in length than the other segments by about one-third and being recessed toward the rear of the oven liner for conforming to the shape of said notch in said eliminator panel; and means for connecting an external electrical power source to said heating element.

6. The smokeless broiler as defined in claim 5 wherein parallel hemicylindrical channels are formed in said eliminator panel for receiving said parallel segments of said heating element, said channels having apertures at their apex for allowing gases and smoke to pass through the panel, said heating element being substantially circular in cross section and being disposed in a spaced relationship with said panel and partially encompassed within said channels to form curved passageways between said heating element and said channels, whereby said heating element is recessed within said eliminator panel and gases passing through said panel travel the curved passageways.

7. In an oven including an oven liner, a ventilation system comprising:

at least two spaced apart vents mounted on the front of the oven for exhausting gases from the oven;

a discharge duct for transmitting gases to said vents, said discharge duct having an inlet for receiving air and gases;

tubular means for receiving and transmitting gases from the oven liner to said inlet;

an intake means for receiving and transmitting air from the area surrounding the oven to said inlet; and said discharge duct being a hemi-toroidal discharge duct with the two distal ends adjacent said vents, said inlet being disposed proximate to the vertex of said hemi-toroidal duct for receiving air and gases from said intake means and said tubular means.

8. The ventilation system as defined in claim 7 wherein said tubular means comprises a vent tube extending from the oven liner to said inlet in said hemi-toroidal duct.

9. The ventilation system as defined in claim 8 wherein the intake means comprises:

a diluter tube encompassing said vent tube, said diluter tube having a plurality of apertures for receiving air; and ducts for receiving and transmitting air from the area surrounding the oven to said plurality of apertures in said diluter tube.

10. In an oven including an oven liner, a ventilation system comprising:

at least two spaced apart vents mounted on the front of the oven for exhausting gases from the oven;

a discharge duct for transmitting gases to said vents, said discharge duct having an inlet for receiving air and gases;

tubular means for receiving and transmitting gases from the oven liner to said inlet;

an intake means for receiving and transmitting air from the area surrounding the oven to said inlet; and said inlet comprising an annular flange extending downwardly from said discharge duct for engaging said intake means and an aperture formed in the center of said annular flange encompassing said tubular means in a spaced apart relationship.

11. In an oven including an oven liner, a ventilation system comprising:

at least two spaced apart vents mounted on the front of the oven for exhausting gases from the oven;

a discharge duct for transmitting gases to said vents, said discharge duct having an inlet for receiving air and gases;

tubular means for receiving and transmitting gases from the oven liner to said inlet;

an intake means for receiving and transmitting air from the area surrounding the oven to said inlet; and said discharge duct being a hemi-toroidal discharge duct having a rectangular cross-section with the two ends of the duct adjacent said vents, said inlet being disposed proximate to the vertex of the hemi-toroidal duct for receiving air and gases from said intake means and said tubular means.

12. The ventilation system as defined in claim 11 wherein said vents are positioned on the front surface of the oven.

13. The ventilation system as defined in claim 12 further comprising louvers to cover said vents.

14. In an oven having an outer housing and an open ended liner disposed therein with a door for closing the liner, the combination comprising:

a vent aperture formed through the top of said liner;

an electrical heating element mounted within the oven liner;

a smoke eliminator panel mounted below the top of the oven liner and covering said vent aperture, said panel having apertures for receiving smoke and gases from the oven liner;

a vent tube extending from said vent aperture for exhausting smoke and gases from said eliminator panel;

a diluter tube encompassing said vent tube;

means for transmitting air from the area surrounding the oven to said diluter tube; and a hemi-toroidal duct having two distal ends and an inlet at its midpoint positioned over the upper ends of said diluter and vent tubes, said hemi-toroidal duct for receiving and transmitting air, smoke and gases from said inlet to said two ends of said duct.

15. A self-cleaning oven comprising:

an outer oven housing;

an oven liner disposed in a spaced apart relationship within the housing to provide a space between the top of said liner and the top of said housing, the top of said liner having an aperture;

a front vent for receiving air from the vicinity of the oven front;

a lower rear vent for receiving air from the lower rear vicinity of the oven;

ducts for directing air from said front and rear vents to said space between the top of said housing and the top of said liner;

a continuous electrical heating element with a plurality of U-shaped bends forming six coplanar parallel segments extending from the rear to the front of said liner, said two middle segments being shorter in length than the other segments and being recessed towards the rear of said liner;

means for connecting an external electrical power source across said heating element;

a substantially rectangular smoke eliminator panel having a front panel edge with a trapezoidal notch formed therein, said panel having parallel channels for receiving said parallel segments of said heating element, said channels having apertures at the apex of each channel for allowing gases to pass through said panel;

means for mounting said panel on the interior top surface of said liner, said panel disposed to cover said aperture in the top of said liner, means for mounting said heating element in a spaced apart relationship on said eliminator panel with said parallel segments being partially encompassed within said channels, the front ends of said two middle segments corresponding to the interior edge of said trapezoidal notch;

a vent tube extending vertically from said aperture in the top of said liner for discharging gases from said eliminator panel;

a three-layer catalytic screen mounted in said vent tube for catalytically oxidizing smoke and gases;

a hemi-toroidal discharge duct having an inlet and two distal duct ends for receiving smoke and gases from said vent tube and directing them towards the front of the oven, said duct receiving smoke and gases through said inlet disposed proximate to the vertex of said discharge duct and discharging the smoke and gases through said two distal duct ends at the front of said oven housing;

a diluter tube encompassing said vent tube and having a plurality of apertures formed about the lower portion of the diluter tube, said diluter tube receiving air through said plurality of apertures and discharging the air through said inlet into said discharge duct to dilute the smoke and gases contained therein; and means on the front of the oven housing for discharging gases from said discharge duct.

* * * * *